US006472627B1

(12) United States Patent
Yoon

(10) Patent No.: US 6,472,627 B1
(45) Date of Patent: Oct. 29, 2002

(54) VACUUM CIRCUIT BREAKER

(75) Inventor: Seok Jung Yoon, Cheongju (KR)

(73) Assignee: LG Industrial Systems Co., Ltd., Seoul (KR)

( * ) Notice: Subject to any disclaimer, the term of this patent is extended or adjusted under 35 U.S.C. 154(b) by 6 days.

(21) Appl. No.: 09/696,018

(22) Filed: Oct. 26, 2000

(30) Foreign Application Priority Data

Oct. 26, 1999 (KR) ..... 99-46592

(51) Int. Cl.[7] ..... H01H 5/00; H01H 33/02
(52) U.S. Cl. ..... 200/400; 218/154
(58) Field of Search ..... 200/400, 401, 200/500, 501, 337; 218/120, 140, 154; 335/185, 190, 192

(56) References Cited

U.S. PATENT DOCUMENTS 4,439,653 A * 3/1984 Umino et al. ..... 200/400
4,821,008 A * 4/1989 Micoud et al. ..... 200/400
4,845,324 A * 7/1989 Martin et al. ..... 200/400
5,981,889 A * 11/1999 Niklaus ..... 200/400
6,087,610 A * 7/2000 Castonguay et al. ..... 200/400
6,144,002 A * 11/2000 Coudert et al. ..... 200/400
6,232,569 B1 * 5/2001 Nakajima et al. ..... 200/400

* cited by examiner

*Primary Examiner*—Michael Friedhofer
(74) *Attorney, Agent, or Firm*—Birch, Stewart, Kolasch & Birch, LLP

(57) ABSTRACT

A contact portion switch device of a circuit breaker which is capable of guaranteeing reliable operation by restraining distortion of each construction part in the operation of the circuit breaker and permitting an easy installation of an additional part for performing multifunction is disclosed. A switch lever installed in order to rotate between a penetration position and a cut-off position of a fixed contact portion and a movable contact portion, a cut-off spring combined to the switch lever, an operating wheel installed on the side of the switch lever so as to be rotational, an operating wheel for rotating the operating wheel, an operating arm installed on the side of the operating wheel so as to be rotational, an electric link interposed between the operating wheel and operating arm, a penetration spring combined to the operating arm, a trip arm combined to a rotating shaft of the switch lever, a trip latch for preventing the switch lever from rotating to the cut-off position, a penetration latch installed on the side of the operating wheel, and a transmission part placed between the operating arm and switch lever is also disclosed.

20 Claims, 6 Drawing Sheets

VACUUM CIRCUIT BREAKER

BACKGROUND OF THE INVENTION

1. Field of the Invention

The present invention relates to a vacuum circuit breaker, in particular to a switching mechanism of a vacuum circuit breaker. In more particular, the present invention relates to a switching mechanism of a vacuum circuit breaker which is capable of guaranteeing the credibility of its operation by restraining distortion of each component and installing additional components easily in order to perform multifunction.

2. Description of the Prior Art

Generally, a circuit breaker is for switching an electric circuit in order to protect a load unit or a load line from abnormal current caused by abnormal situations such as a short circuit occurrence on electric circuits from a power plant or a substation to an electric facility of a consumer, the circuit breaker is divided into an AC circuit breaker and a DC circuit breaker according to an applied line, and it is divided into a vacuum circuit breaker and a gas circuit breaker according to an arc shielding medium when the contact is switching.

Generally, inside of the circuit breaker is vacuum or is filled with an insulating material, and an arc-extinguishing unit for shielding arc generated in the switching operation of a fixed contactor and a movable contactor installed in the vacuum area or insulating material filled area is disposed in the circuit breaker. A switching mechanism for providing driving force is connected to an extended end of the movable contactor exposed-installed from the sealed area in order to contact or separate the movable contactor to/from the fixed contactor.

The conventional switching mechanism for the vacuum circuit breaker will now be described with reference to accompanying FIG. 1. The construction and operation of the conventional switching mechanism for the vacuum circuit breaker is referable in the U.S. Pat. No. 5,140,117.

In the conventional switching mechanism for the vacuum circuit breaker, the end portion of a switch lever 111 having a long plate shape is connected to a movable contact portion 105, the switch lever 111 is installed centering around a first rotating shaft 113 so as to be movable to a turn-ON position or turn-OFF position where the movable contactor 105 and fixed contactor 103 are mutually contacted or separated in order to contact or separate the movable contactor 105 to/from the fixed contactor 103. A lever driving unit 121 comprises a cut-off spring 117 coupled to the switch lever 111 in order to drive the switch lever 111. One end portion of an arm 115 is coupled to the other end portion of the switch lever 111, the other end portion of the arm 115 is contacted to the lever driving unit 121. A slave roller 116 is coupled to a free end portion as the other end portion of the arm 115 so as to be rotatable in order to be transferred by contacting a cam. The cut-off spring 117 is combined to the first rotation shaft 113 with a certain distance in order to press the switch lever 111 elastically to the turn-OFF position.

Hereinafter, the structure of the lever driving unit 121 will now be described in detail.

Conventionally, the lever driving unit 121 of the switching mechanism for the circuit breaker comprises a second rotating shaft 124 fixed on a base plate 121*a*. An end portion of a turn-on spring 135 is combined to the second rotating shaft 124. The cam 129 is coupled to the rotating shaft 131 coupled to the other end portion of the turn-on spring 135 so as to be rotatable, and performs a relative motion by contacting mutually to the slave roller 116. A supporting unit 123 is coupled to the rotating shaft 131 so as to be rotatable in order to rotate centering around the turn-on spring 135. A turn-on latch 137 is coupled to the side of the cam 129 so as to be rotational in order to make the turn-on spring 135 maintain an extension state by restraining the rotation of the cam 129. A trip latch 139 is installed on the free end portion of the supporting unit 123 in order to prevent the supporting unit 123 from rotating by being pressed by the cut-off spring 117. A stopper 127 is installed on the side of the trip latch 139 in order to restrain the rotation of the supporting unit 123 by contacting mutually with the supporting unit 123.

The cam 129 is installed so as to rotate centering around the rotating shaft 131 projected from the plate surface of the supporting unit 123, and the other end portion of the turn-on spring 135 is combined to the side of the cam 129 in order to rotate the cam 129.

And, a stopper pin 133 is protrusively disposed on the side surface of the cam 129, a roller 134 is installed on the stopper pin 133 so as to be rotational in order to contact the free end portion of the turn-on latch 137.

Hereinafter, the operation of the conventional switching mechanism for the vacuum circuit breaker will now be described.

First, in order to make the movable contactor contact to the fixed contactor 103, the turn-on 137 rotates in order to separate from the roller 134 of the stopper pin 133 of the cam 129.

By the above said operation, the turn-on latch 137 is separated from the roller 134, as depicted in FIG. 2, at the same time the cam 129 rotates to the clockwise direction by the tensile force of the turn-on spring 135.

According to the rotation of the cam 129, the slave roller 116 is pressed so as to separate from the rotating shaft 131 of the cam 129, accordingly the switch lever 111 rotates toward the turn-ON position centering around the first rotating shaft 113.

According to the rotation of the switch lever 111, the fixed contactor 103 and movable contactor 105 are contacted each other, the cut-off spring 117 is elastically energized by being extended according with the rotation of the switch lever 111.

On the contrary, in order to make the movable contactor 105 separate from the fixed contactor 103, the trip latch 139 rotates in order to separate from the end portion of the supporting unit 123.

According to the rotation, when the trip latch 139 is separated from the supporting unit 123, as depicted in FIG.2, the switch lever 111 rotates to the counter clock-wise direction centering around the first rotating shaft 113 by the tensile force of the cut-off spring 117. According to this, the supporting member 123 rotates temporarily centering around the second rotating shaft 124, but the rotation of the supporting unit 123 is stopped by contacting to the stopper 127.

Accordingly, according to the rotation of the switch lever 111, the movable contactor 105 is separated from the fixed contactor 103.

However, in the conventional vacuum circuit breaker, the supporting unit rotates centering around the second rotating shaft by the tensile force of the cut-off spring, and the rotation is stopped by contacting with the stopper 127 with an impact on the both supporting unit 123 and stopper 127. When the operation is performed repeatedly, the distortion and separation of the construction parts including the cam can occur due to the impact force caused by the contact between the supporting unit 123 and stopper 127. And, it may causes below problems.

First, the credibility of the apparatus can be lower because the turn-on or

Turn-off operation may not be performed smoothly due to the distortion of the construction parts caused by the impact force.

Second, in the conventional vacuum circuit breaker, the eccentric-installed switch lever and arm supported by the cut-off spring and the cam supported by the turn-on spring are suspended on the lower portion of the each spring, and the fixed supporting position for each spring is same as upper position.

Moreover, the switch lever is made with a steel plate having long length and the cam is made with the steel plate having long width, the gravity of the switch lever and cam have a bad effect on the compression/extension operation of the springs for contacting or separating the movable contactor to or from the fixed contactor. In particular, because the conventional vacuum circuit breaker uses a two link having the switch lever and operating arm, the gravity of the two link is more concentrated on the cut-off spring than the gravity of a multi link.

Third, when there is a need to add a new function, additional installation is difficult because the lever operating unit comprising the two springs and cam is constructed as the one assembly unit.

Fourth, the life span of the circuit breaker can lower due to over-energizing of the turn-on spring because there is no detecting means for detecting the energizing completion of the turn-on spring when the turn-on spring is elastically energized.

Fifth, in the conventional vacuum circuit breaker, there is no displaying means for displaying the energizing completion state or energizing energy exhaustion state of the turn-on spring, accordingly it is inconvenient for a user to use the circuit breaker.

Sixth, there is no displaying means for displaying the turn-ON or turn-OFF state of the main circuit, accordingly it is inconvenient for the user to use the circuit breaker.

SUMMARY OF THE INVENTION

The object of the present invention is to provide a switch device for a vacuum circuit breaker which is capable of solving the above-mentioned problems.

The first problem of the conventional technology can be solved by providing the switch device for the vacuum circuit breaker according to the present invention which does not comprises a stopper restricting the rotation of a supporting unit.

The second problem of the conventional technology can be solved by <providing the switching mechanism for the vacuum circuit breaker which comprises a first and a second spring for providing power for contacting movable contactor the fixed contactor or separating the movable contactor from the fixed contactor, wherein the first spring being providable the power for contacting the movable contactor to the fixed contactor when it is elastically energized, and the second spring being providable the power for separating the movable contactor from the fixed contactor when it is elastically energized, each of the first and second spring having one end portion being a operating point for providing the power and the other end portion for providing a supporting point to be extended or compressed, each of said other end portions of the first and second spring being placed to be vertically opposite;

a plurality of link means for providing the power provided from the first spring or the second spring to the movable contactor; and a spring energizing means for energizing at least one spring among the first and second spring.

The third problem of the conventional technology can be solved by providing the vacuum circuit breaker according to the present invention which is capable of installing easily a new function mean such as a displaying mean for displaying an original position return state or extension state of the turn-on spring or displaying a turn-ON (ON) state or turn-OFF (OFF) state of the circuit breaker.

The fourth problem of the conventional technology can be solved by providing the vacuum circuit breaker according to the present invention which comprises a driving wheel including a gear portion for receiving the power on the outer circumference and a gearless portion for detecting the energizing completion of the turn-on spring on the outer circumference.

The fifth problem of the conventional technology can be solved by providing the vacuum circuit breaker comprising a display plate including a display unit which is co-axially connected to the rotating shaft of the driving arm in order to rotate according to the rotation of the driving arm and display the energizing state or energizing energy exhaustion state of the spring on the front plate of the vacuum circuit breaker, and a see through window installed on the front surface of the vacuum circuit breaker in order to watch the display unit of the display plate.

The sixth problem of the present invention can be solved by providing the vacuum circuit breaker comprising a display plate including a display unit which is co-axially connected to the rotating shaft of the switch lever in order to rotate according to the rotation of the switch lever and display the turn-ON or turn-OFF state of the main circuit on the upper surface, and a see through window installed on the front surface of the vacuum circuit breaker in order to watch the display unit of the display plate.

DETAILED DESCRIPTION OF THE PREFERRED EMBODIMENT

Hereinafter, the embodiments of a switching mechanism of a vacuum circuit breaker according to the present invention will now be described with reference to accompanying drawings.

The present invention can be embodied many ways, hereinafter the preferred embodiment will now be described.

Figure 1:
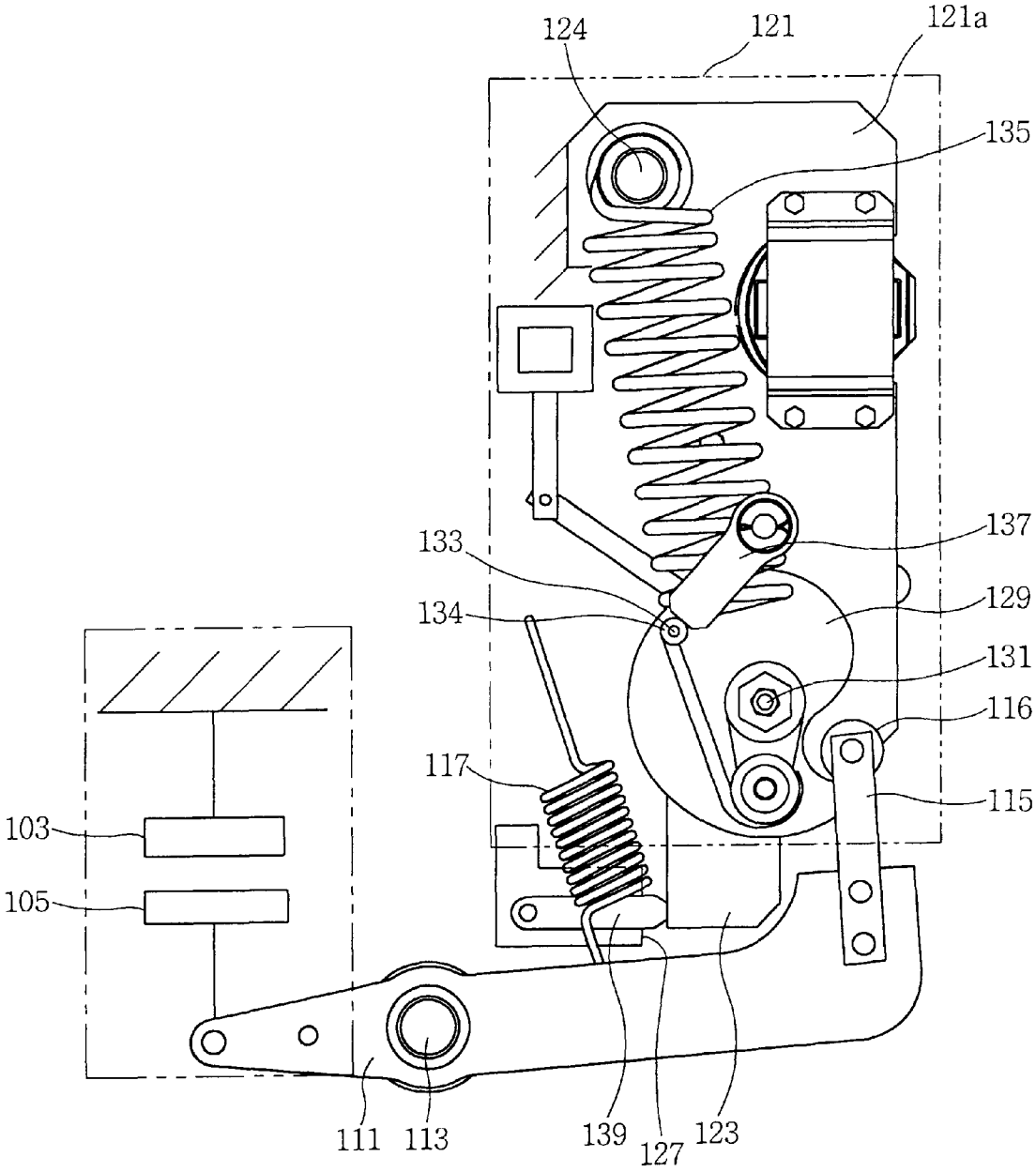
FIG. 1 CONVENTIONAL ART
FIG. 1 is a side view illustrating the conventional switch device of the vacuum circuit breaker.
Figure 2:
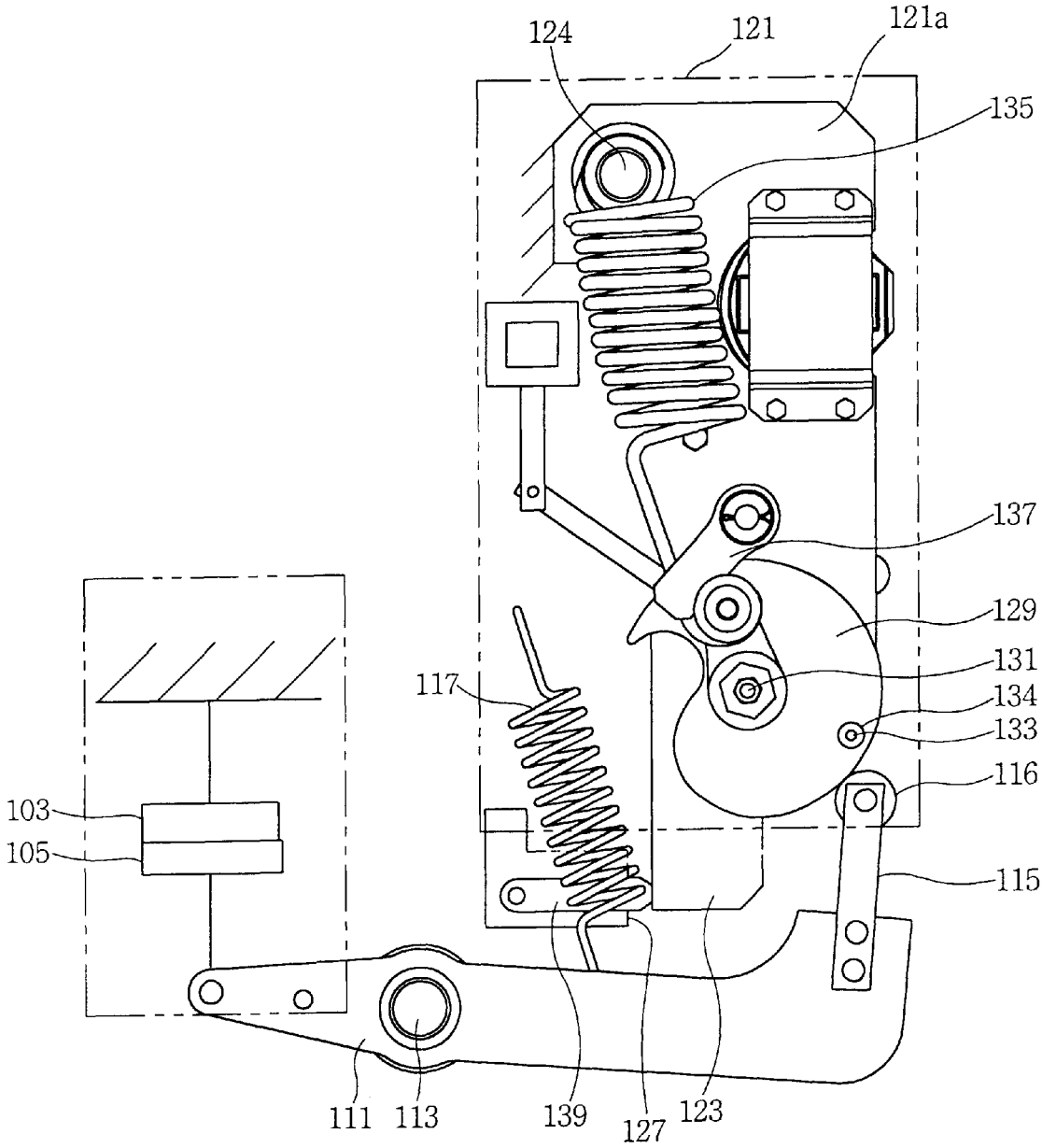
FIG. 2 CONVENTIONAL ART
FIG. 2 is a side view illustrating a turn-ON state of the conventional switch device of the vacuum circuit breaker.
Figure 3:
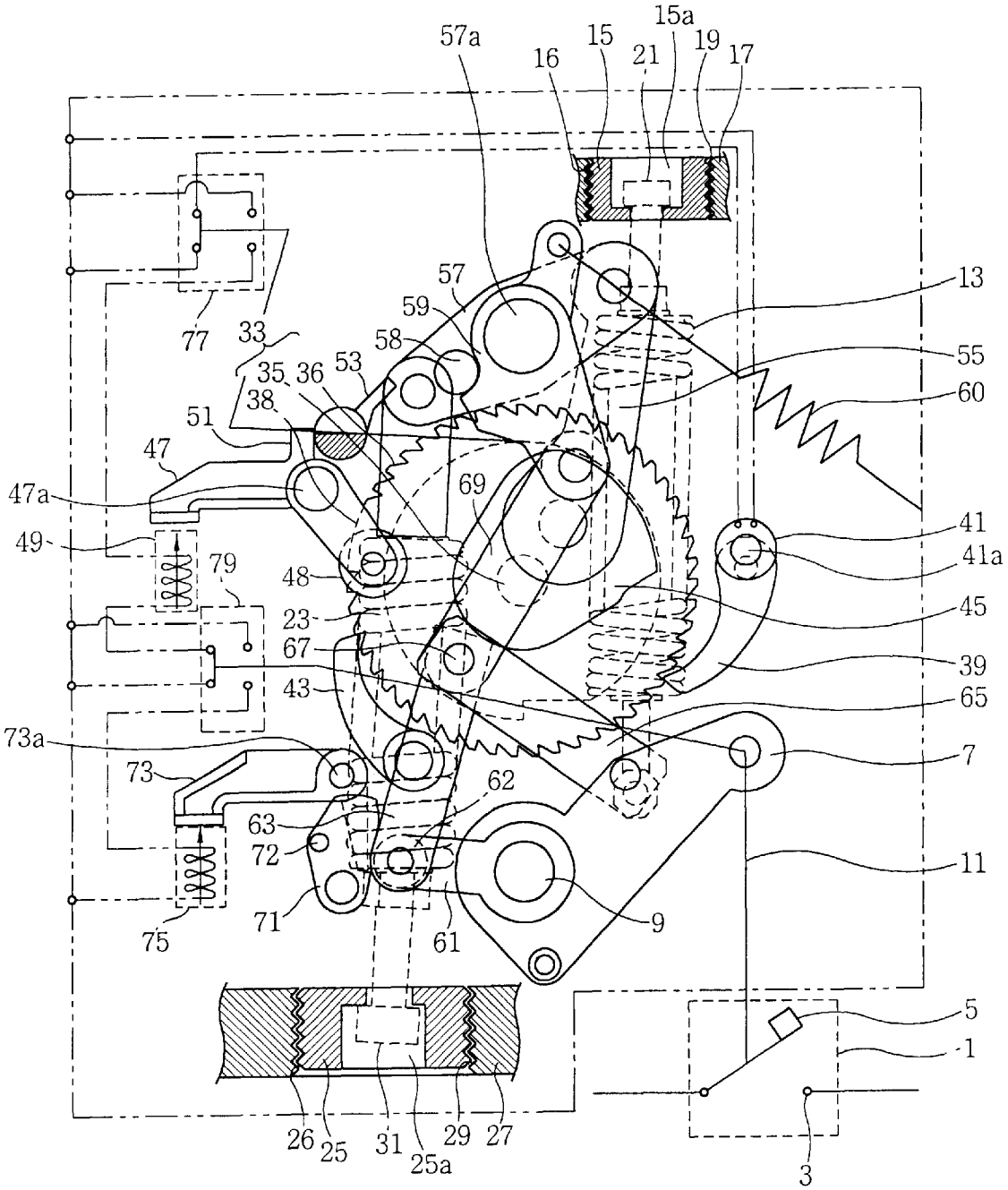
FIG. 3 is a front view illustrating a switch device of a vacuum circuit breaker according to the embodiment of the present invention.

FIG. 3 is front view illustrating an initial state of the switching mechanism of the vacuum circuit breaker according to the embodiment of the present invention. Herein, the initial state means a main circuit is turned-off state, in other words, a movable contactor and a fixed contactor are separated, a turn-ON spring and a cut-off spring are not elastically energized.

As depicted in FIG. 3, the switching mechanism according to the embodiment of the present invention comprises a switch lever 7 installed so as to be rotational to a switch-ON position or switch-OFF position where a fixed contactor 3 of a arc-extinguishing unit 1 contacts or separates to/from a movable contact portion 5. The end of a cut-off spring 13 for providing the energized elastic force is contacted to the upper portion adjacent to the length-directional center portion of the switch lever 7 in order to make the switch lever 7 rotate to the switch OFF position.

And, the switch lever 7 is installed so as to be rotational centering around a rotating shaft 9 which length-directionally penetrates the side portion of the switch lever 7, the end of a connection link 11 connected to the movable contactor 5 is coupled to the end portion of the switch lever 7 placed opposite to the rotating shaft 9 in order to perform a relative motion.

A first movable supporting member 15 is coupled to the other end of the cut-off spring 13 on which a first stopping portion 21 is formed so as to adjust the Elastic force of the cut-off spring 13, and a first recess portion 15*a* is formed inside of the first movable supporting member 15 for containing the first stopping portion 21 so as to perform pivot.

A first male threaded portion 16 is formed on the outer circumference of the first movable supporting member 15, and is partly or totally meshed or separated to/from a first female threaded portion 19 formed on the inner circumference of a first fixed supporting member 17 placed corresponding to the first male threaded portion 16. Accordingly, the elastic force of the cut-off spring 13 can be adjusted because the first movable supporting member 15 can move along the axial line corresponding to the first fixed supporting member 17.

Meanwhile, a driving wheel 33 is installed so as to be rotational centering around a rotating shaft 35 placed parallel to the rotating shaft 9 of the switch lever 7 to the axial line direction.

A geared portion 36 having a tooth formed with a predetermined portion is formed on the outer circumference of the driving wheel 33, and a gearless portion 38 having a arch shape is formed on the outer circumference of the driving wheel 33.

And, an driving pole 39 is installed on one side position of the driving wheel 33 for rotating the driving wheel 33 for making move the driving wheel 33 as much as the one teeth interval by meshing with the teeth of the geared portion 36, and a reverse rotation restraining pole 43 is installed on the other side position of the driving wheel 33 in order to permit the clock-wise direction rotation of the driving wheel 33 by meshing with the tooth of the driving wheel 33 and at the same time restrain the counter clock-wise direction rotation of the driving wheel 33.

A rotating shaft of the driving pole 39 is connected to the rotating shaft 41 a of an driving motor 41 for rotating the driving pole 39 through a power transmission means such as a crank shaft (not-shown) or a speed and torque transformable means such as a transmission.

Meanwhile, the other embodiment such as transmitting the power of the motor 41 to the driving wheel 33 through a gear instead of the driving pole 39 is possible. In addition, in order to make the turn-on spring energize elastically by a manual operation instead of the driving motor 41, it is possible in the other embodiment to install a handle shaft its end is exposed to a front plate (not shown) of the vacuum circuit breaker and the other end is contacted to the driving pole 39. Herein, a handle (not shown) is combined to the end of the handle shaft exposed on the front plate of the vacuum circuit breaker in order to provide the driving force. In addition, combining the manual operation embodiment with the embodiment using the gear as the power transmission means to the driving wheel 33 is possible.

Meanwhile, a turn-on cam 45 is coaxially connected to the rotating shaft 35 of the driving wheel 33 so as to rotate integrally with the driving wheel 33. A turn-on latch 47 is installed on one side position deviated from the trajectory of the turn-on cam 45 being rotatable in order to maintain the energizing state of the turn-on spring 23 by preventing the rotation of the turn-on cam 45 and driving wheel 33 when the energizing of the turn-on spring 23 is completed. A rotation restraining roller 48 is installed rotatable by using the rotating shaft 47*a* of the turn-on latch 47 as the rotating shaft and it rotates to the position permitting the rotation of the cam 45 by releasing the contact with the cam 45 or the contact position with cam 45 in order to restrain the further rotation of the cam 45 when the energizing of the spring is completed.

The turn-on latch 47 rotates to the same direction of the rotation restraining roller 48 by being coaxially connected to the rotation straining roller 48, and transmits the rotating force to the rotation restraining roller 48.

In order to provide the rotating force to the turn-on latch 47, a turn-on solenoid 49 is placed on the position where the turn-on latch 47 is pushed and is rotated.

The end of a link 55 is coupled to the turn-on cam 45 with a predetermined distance from the rotation shaft 35 so as to perform the relative motion with the turn-on cam 45. The other end of the link 55 is coupled to the end of the driving arm 57, the driving arm 57 can rotate to the clock-wise or counter clock-wise direction centering around the rotating shaft 57*a* placed parallel to the rotating shaft 35 of the driving wheel 33 correspondingly with the rotation of the driving wheel 33.

In other words, the link 55 is placed between the driving wheel 33 and driving arm 57, and transmits the power from the driving wheel 33 to the driving arm 57.

Meanwhile, the other end of the driving arm 57 is coupled to the end of the turn-on spring 23. The turn-on spring 23 rotates the switch lever 7 to the switch-ON position, and at the same time provides the driving force for making the cut-off spring 13 energize elastically.

In the meantime, a second movable supporting member 25 is coupled to the other end of the turn-on spring 23 in order to adjust the elastic force of the turn-on spring 23.

A second stopping portion 31 is formed on the other end of the turn-on spring 23, and a second recess portion 25*a* is formed inside of the second movable supporting member 25 in order to receive-support the second stopping portion 21 so as to perform the pivot.

And, a second male threaded portion 26 is formed on the outer circumference of the second movable supporting member 25. A second female threaded portion 29 corresponding to the second male threaded portion 26 is formed on the inner circumference of the second fixed supporting member 27, the second movable supporting member 25 is fastened or unfastened by the second male female threaded portion 29, accordingly the second movable supporting member 25 partially or totally coupled or separates to/from the second fixed supporting member 27.

The second movable supporting member 25 adjusts the elastic force of the turn-on spring 23 by moving along the axial line corresponding to the second fixed supporting member 27 after receiving the end of the turn-on spring 23 in order to perform the pivot and be stopped-fixed along the axial line.

Meanwhile, a stopping protrusion 51 is protrusively formed adjacent to the rotating shaft 47*a* of the turn-on latch 47. A turn-on latch locking bar 53 is installed on the portion corresponding to the stopping protrusion 51, the turn-on latch locking bar 53 restrains or permits the rotation of the turn-on latch 47 by contacting or separating to/from the stopping protrusion 51 by being rotated by the arm 59 rotating to the clock-wise direction.

In more detail, the turn-on latch locking bar 53 comprises a body having a semicircle cross-sectional shape and a protruded portion to be contactable with the arm 59. Accordingly, when the vacant semicircle cross-sectional portion of the body is opposite to the stopping protrusion 51, the turn-on latch 47 is permitted to rotate to the clock-wise direction, when the remained semicircle cross-sectional portion of the body is opposite to the stopping protrusion 51, the rotation of the turn-on latch 47 is restrained.

The arm 59 is coaxially connected to the rotating shaft 57*a* of the driving arm 57, and rotates to the clock-wise direction centering around the rotating shaft 57*a* of the driving arm 57. One end of the driving arm 59 is contacted to a returning spring 60 for returning the arm 59 to the original position, and the other end of the driving arm 59 opposing in length direction to the one end of the driving arm 59 is coupled to a third link 69.

In order to restrain the rotation of the driving arm 59, a stopping pin portion 58 is protruded from a base surface of the driving arm 57, one end of the arm 59 corresponding to the stopping pin portion 58 has an arch-shaped portion in order to increase the contact area between the stopping pin portion 58.

Meanwhile, a trip arm 61 for restraining the clock-wise rotation and permitting the counter clock-wise rotation is coaxially connected to the rotating shaft 9 of the switch lever 7 so as to rotate to the same rotation direction of the switch lever 7.

The other end of the trip arm 61 extended from the one end connected to the rotating shaft 9 is connected to a power transmission means. The power transmission means comprises at least three link means, is placed between the driving arm 57 and switch lever 17, provides the elastically energized force of the penetration spring 23 or the elastically energized force of the cut-off spring 13 to the switch lever 7, and rotates the switch lever to the switch-ON position or switch-OFF position. The power transmission means will now be described in detail.

The other end of the trip arm 61 is connected to a first link 63 so as to be rotational, a second link 65 is connected to the switch lever 7 so as to be rotational, the first and second link 63, 65 are arrayed centering around a connecting pin 67 so that the degree between the first and second link 63, 65 may have lower angle than 90°. The one end of a third link 69 is rotatably coupled to the free end of the arm 59 and the other end of a third link 69 is connected to the connecting pin 67.

In the meantime, a roller 62 is coupled to the extended end of the trip arm 61 where the first link 63 is coupled so as to be rotational, the roller 62 contacts with the trip latch 71 installed so as to be rotational centering around a latch pin 72 without an impact, accordingly the rotation of the trip arm 61 is restrained.

The latch pin 72 is formed on the trip latch 71, one end of the trip lever 73 placed so as to be rotational centering around the rotating shift 73*a* disposed on the side position of the latch pin 72 can contacts with the latch pin 72.

Meanwhile, a trip solenoid 75 for making the trip latch 71 rotate the trip arm 61 and switch lever 7 to the switch OFF position by rotating the trip lever 73 is coupled to the other end of the trip lever 73.

And, a first switch 77 is connected to the power supplying circuit of the operating motor 41 in order to cut off the power to the driving motor 41 on detecting idleness of the driving pole 39 when the gearless portion 38 of the driving wheel 33 contacts with the driving pole 39.

The first switch 77 cuts off the power of the motor 41, and at the same time turns on the power circuit to the turn-on solenoid 49.

And, a second switch 79 is installed between the turn-on solenoid 49 and trip solenoid 75, and one end of the second switch 79 is connected to the switch lever 7 in order to connect the power circuit to the turn-on solenoid 49 when the switch lever 7 is placed to the switch-OFF position by operating corresponding with the switching operation of the switch lever 7. At the same time, the second switch 70 cuts off the power circuit to the trip solenoid 75, when the switch lever is placed on the switch-ON position, it connects the power circuit to the trip solenoid 75, and at the same time separates the power circuit to the penetration solenoid 49.

Meanwhile, a displaying mean for displaying the energizing completion state or energizing energy exhaustion state of the turn-on spring 13 can be installed according to the embodiment of the present invention.

Herein, the displaying mean comprises a display plate (not shown) coupled to the driving arm 57 and rotating shaft 57*a* of the arm 59 among the link means rotating corresponding to the energizing completion state or energizing energy exhaustion state of the turn-on spring 23 and having a display portion corresponding to the each state, and a see through window (not shown) installed on the front plate (so called front panel) (not shown) of the circuit breaker corresponding to the display portion. It is desirable for the display plate to have a cam shape, a picture indication or a character indication indicating the extension/return of the spring corresponding to the energizing completion state or energized energy exhaustion state can be embodied. The see through window is installed on the position corresponding to the display plate on the front plate (front operation panel) exposed to the user operating the circuit breaker.

In addition, it is desirable to display the turn-ON state or turn-OFF state of the main circuit of the vacuum circuit breaker to the user. The display means for displaying the states comprises a display plate (not shown) coupled to the rotating shaft 9 of the switch lever 7 rotating according to the turn-ON state or turn-OFF state of the circuit breaker and having a display portion corresponding to the each state on the upper portion, and a see through window (not shown) installed on the front plate of the circuit breaker corresponding to the position corresponding to the display unit. The display plate can be embodied as a plate having a cam shape as same as the display plate of the turn-on spring 23, and the character indication indicating the turn-on/turn-off or ON/OFF can be embodied on the front surface. The see through window is installed on the front surface (front operation panel) exposed to the user operating the circuit breaker corresponding to the position to the display plate.

Hereinafter, the operation and effect of the switch device according to the embodiment of the present invention will now be described with reference to accompanying FIG. 4–6.

First, when the power circuit of the motor 41 is connected by the first switch 77, the power is applied, and the motor 41 rotates, accordingly the driving pole 39 rotates.

Herein, when the driving pole 39 rotates one time, the driving wheel 33 rotates with the one teeth interval, the reverse rotation restraining pole 43 placed centering around the driving wheel 33 to be opposite to the driving pole 39 prevents the counter lock-wise rotation of the driving wheel 39.

Figure 4:
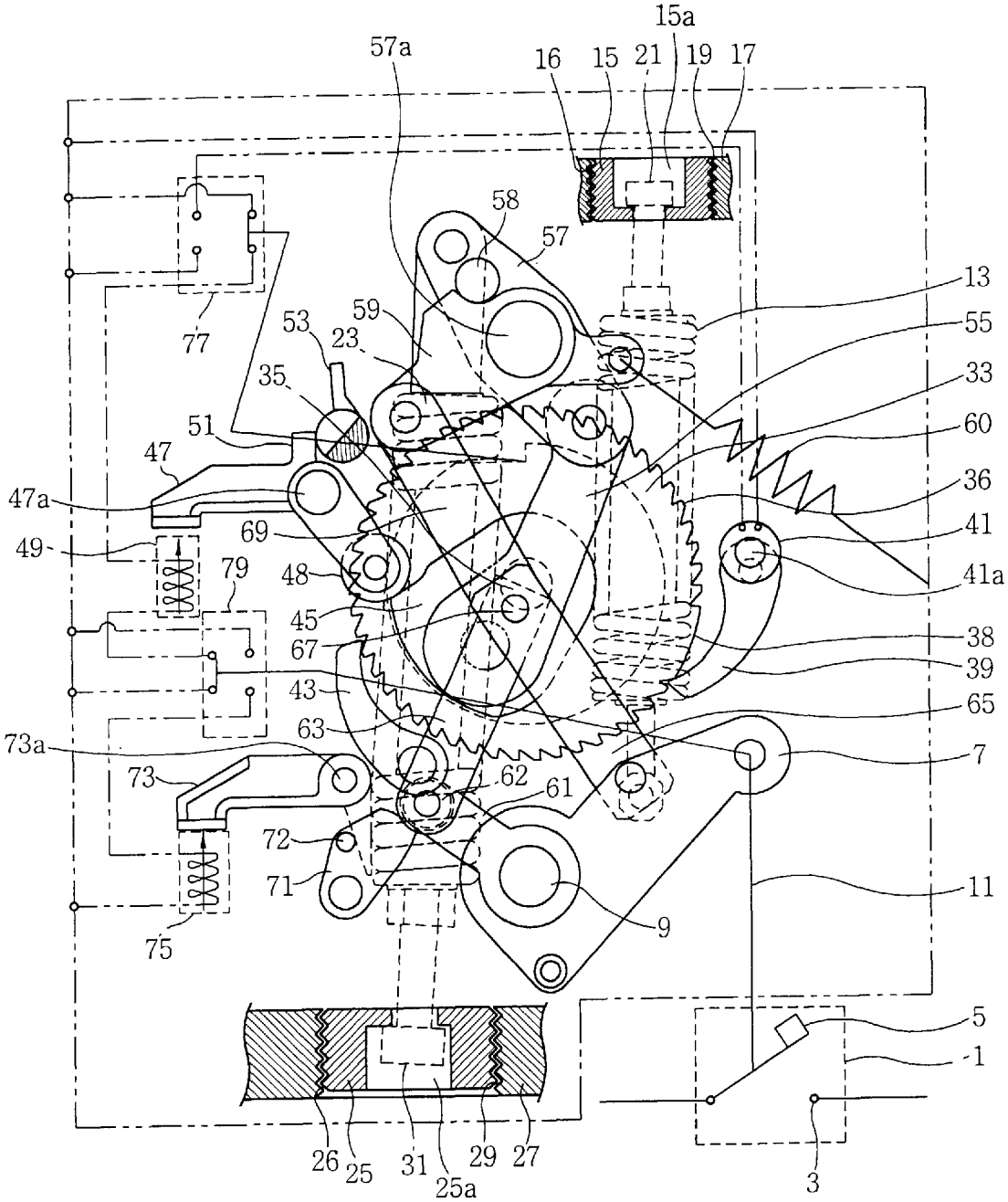
FIG. 4 is a front view illustrating a turn-OFF state of the switch device of the vacuum circuit breaker according to the embodiment of the present invention.

As depicted in FIG. 4, when the driving wheel 33 rotates to the clock-wise direction, the driving arm 57 rotates to the clock-wise direction by the link 55 coupled to the turn-on cam 45, and the turn-on spring 23 coupled to the other end of the driving arm 57 is extended according to the rotation of the driving arm 57.

And, the third link 69 coupled to the opposing end to the end of the arm 59 being pulled by the returning spring 60 is upwardly lifted by the arm 59, according to this, the first and second link 63, 65 coaxially coupled to the third link 69 are upwardly lifted, the switch lever 7 rotates to the counter clock-wise direction centering around the rotating shaft 9, and the movable contactor 5 is separated from the fixed contactor 3 through the connection link 11. Accordingly, the main circuit is cut-off.

As depicted in FIG. 4, according to this, the connecting pin 67 moves towards the rotating shaft 35 of the operating wheel 33, and the second link 65 is placed on the straight line of the third link 69.

Meanwhile, when the driving wheel 33 rotates as a predetermined angle, the turn-on spring 23 reaches to the maximum extended point, the roller contact portion of the turn-on cam 45 contacts to the rotation restraining roller 48, accordingly the rotation of the turn-on cam 45 and driving wheel 33 stop.

Herein, the driving pole 39 performs the idling without rotating the driving wheel 33 by contacting with the gearless portion 38.

Accordingly, according to the above-mentioned operation, when a detecting device (not shown, such as a rotary encoder installed on the rotating shaft of the driving wheel for generating a pulse signal corresponding to the rotation) detects the stop state of the driving wheel 33, the first switch 77 cuts-off the power circuit to the motor 41, and at the same time the first switch 77 switches in order to connect the power circuit to the turn-on solenoid 49.

As described above, when the turn-on spring 23 is extended and the arm 59 rotates by the returning spring 60, the turn-on latch locking bar 53 returns to the rotation permission position permitting the rotation of the turn-on latch 47.

Meanwhile, in the circuit cut-off state as depicted in FIG. 4, the operation of the switching mechanism of the vacuum circuit breaker of the present invention which switches the main circuit to the turn-ON state will now be described with reference to accompanying FIG. 5.

In order to connect the power to the main circuit by contacting the movable contactor 5 to the fixed contactor 3, when the power circuit of the turn-on solenoid 49 is connected, the power is applied to the turn-on solenoid 49. And, as depicted in FIG. 5, the rotation restraining roller 48 is separated from the turn-on cam 45 by rotating the turn-on latch 47 by the turn-on solenoid 49.

Figure 5:
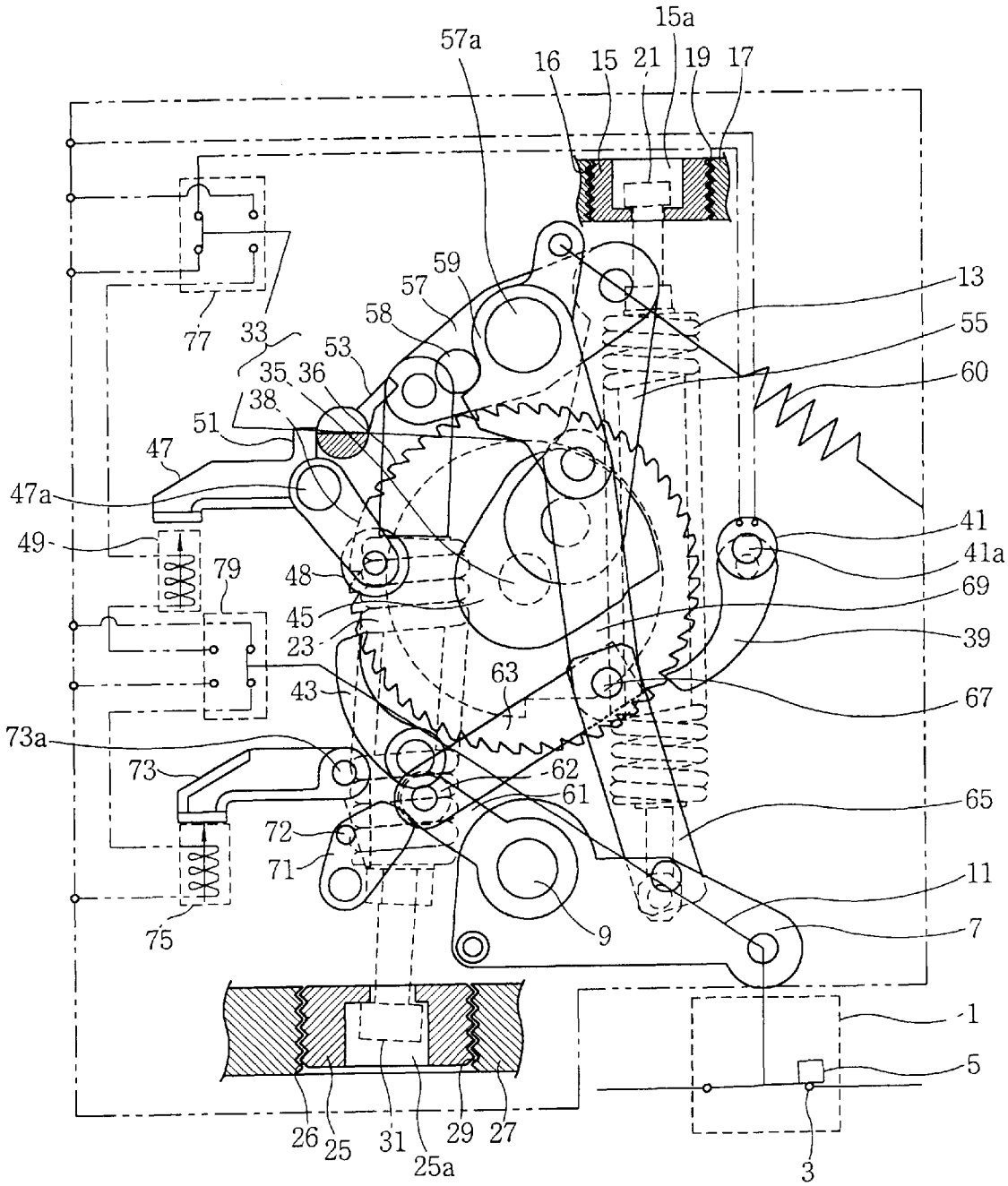
FIG. 5 is a front view illustrating a turn-ON state of the switch device of the vacuum circuit breaker according to the embodiment of the present invention.

According to this, as depicted in FIG. 5, the turn-on spring 23 is returned, and the arm 57 and arm 59 rotate to the counter clock-wise direction. At the same time, the wheel 33 and cam 45 rotate to the clock-wise direction.

Herein, the third link 69 coupled to the end of the arm 59 downwardly compresses the first and second link 63, 65 coupled through the connecting pin 67, and the switch lever 7 rotates to the switch-ON position.

Accordingly, the cut-off spring 13 coupled to the switch lever 7 is extended and elastically energized by the rotation of the switch lever 7, the movable contactor 5 connected to the connecting link 11 and switch lever 7 contacts with the fixed contactor 3. Accordingly, the main circuit is in the conduction (turn-on) state.

Herein, the trip arm 61 rotatably coupled to the switch lever 7 rotates following the switch lever 7, the roller 62 coupled to the extended end of the trip arm 61 rotates to the clock-wise direction while contacting with the trip latch 71.

Herein, the trip latch 71 is applied the elastic force so as to rotate to the clock-wise direction by a spring (not shown), it prevents the roller 62 from reverse-rotating to the counter clock-wise direction after passing the trip latch 71, accordingly the switch lever 7 maintains the switch-ON position.

When the switch lever 7 rotates to the switch-ON state, the second switch 79 connected to the switch lever 7 corresponds with the rotation of the switch lever 7, separates the power circuit to the turn-on solenoid 49, and at the same time connects the power circuit to the trip solenoid 75 (right side contact closed state in FIG. 5).

In the meantime, the turn-on spring 23 is returned while making the switch lever 7 rotate to the switch-ON position, the turn-on latch locking bar 53 follows the rotation of the arm 59, and moves to the rotation restraining position so as to restrain the rotation of the turn-on latch 47.

At the same time with the rotation of the switch lever 7 to the switch-ON position, the first switch 77 connected to the driving wheel 33 by a connecting member (not shown) corresponds with the rotation of the driving wheel 33, cuts-off the power circuit to the turn-on solenoid 49, and at the same time connects the power circuit to the motor 41.

Herein, when the motor 41 rotates responding to a control from a control unit (not shown), the driving pole 38 rotates in order to rotate the wheel 33 as the one teeth interval.

Figure 6:
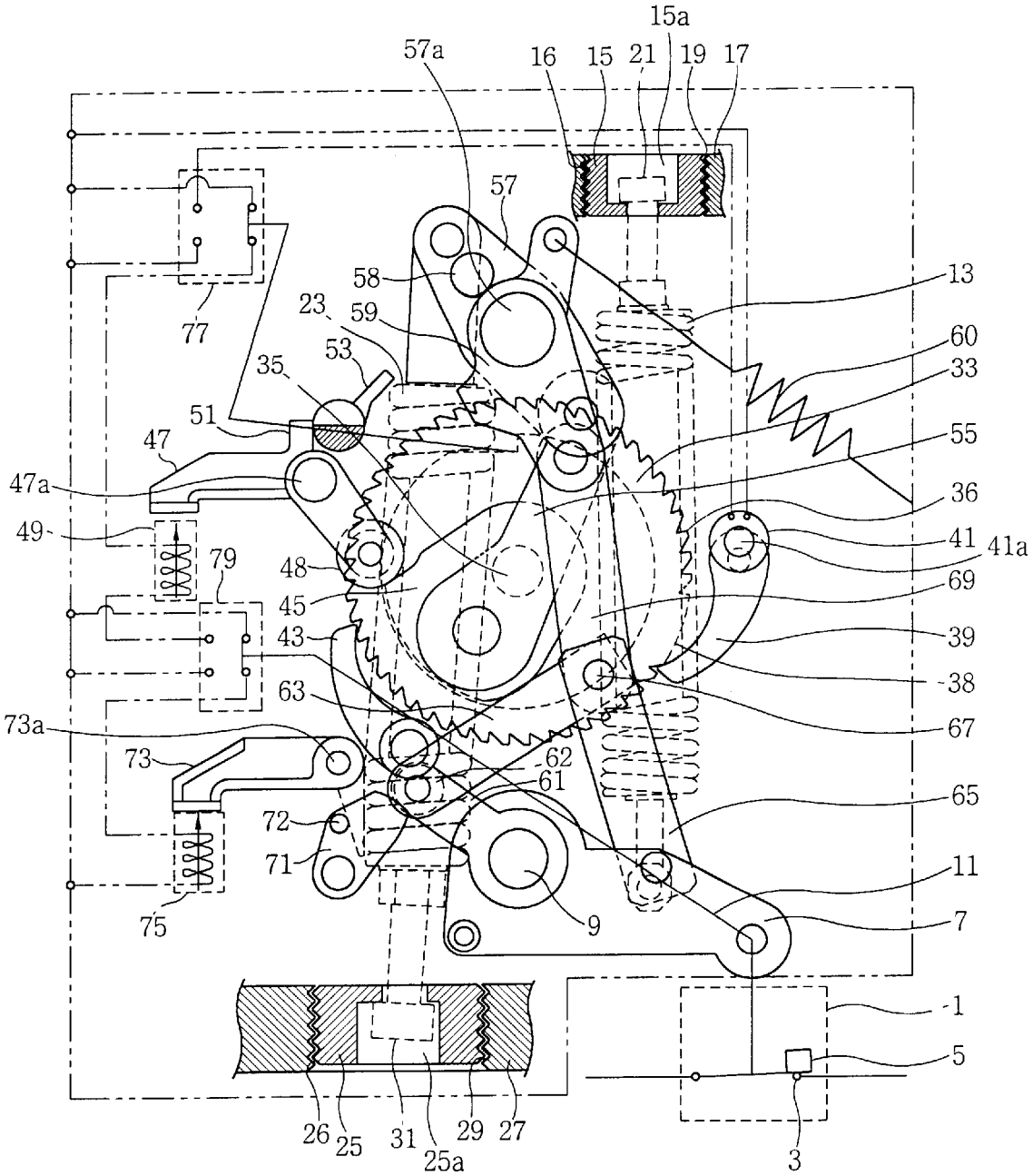
FIG. 6 is a front view illustrating an extended state of a penetration spring and a cut-off spring used in the switching mechanism of the vacuum circuit breaker according to the embodiment of the present invention.

As described above, the arm 57 rotates by the link 55 corresponding with the rotation of the wheel 33, the spring 23 is extended by corresponding with the rotation of the arm 57, and the spring 23 is elastically energized, accordingly the circuit breaker according to the present invention is in the state depicted in FIG. 6.

Hereinafter, the switch-OFF operation of the switch device according to the present invention will now be described.

As depicted in FIG. 6, in the extended state (elastically energized state) of the spring 23 and spring 13, when the over current flow due to the short circuit of the electric circuit or grounding error is detected, the control unit (not shown) applies the power to the trip solenoid 75, and rotates the trip lever 73.

According to this, the trip lever 73 pulls the latch pin 72 of the trip latch 71, the trip latch 71 rotates to the counter clock-wise direction, accordingly the trip latch 71 separates from the end of the trip arm 61.

And, the trip arm 61 and switch lever 7 rotates instaneously to the counter clock-wise direction by the elastic energy of the cut-off spring 13, the movable contactor 5 is separated from the fixed contactor 3.

Herein, the turn-on spring 23 stands by in the extended state, accordingly it can perform turn-on operation at the same time.

As above mentioned embodiments, the gear portion and gearless portion are formed on the circumference of the driving wheel, the driving pole and driving restraining pole are constructed in order to make the driving wheel rotate with the unit teeth interval, but it is also possible to rotate the driving wheel by forming the gear portion around the circumference of the driving wheel and forming an driving gear on the rotating shaft of the driving motor so as to be meshed with the driving wheel.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the meets and bounds of the claims, or equivalence of such meets and bounds are therefore intended to be embraced by the appended claims.

What is claimed is:

1. A vacuum circuit breaker comprising:

a movable contactor;

a fixed contactor;

a first and a second spring for providing a spring force for engaging the movable contactor with the fixed contactor in a contact position or separating the movable contactor from the fixed contactor in a non-contact position, said first spring providing the spring force for engaging the movable contactor with the fixed contactor when said first spring is elastically energized, and said second spring providing the spring force for separating the movable contactor from the fixed contactor when said second spring is elastically energized;

said first spring having a one end portion for providing the spring force and an other end portion for providing a supporting point to be extended or compressed;

said second spring having a one end portion for providing the spring force and an other end portion for providing a supporting point to be extended or compressed, wherein said other end portion of the first spring is arranged vertically opposite to said other end of said second spring;

a plurality of links providing the spring force provided from the first spring or the second spring to the movable contactor; and means for energizing at least one spring among the first and second spring.

2. The vacuum circuit breaker according to claim 1, further comprising means for supporting at least one spring among the first and second spring in order to adjust the spring force of the at least one spring.

3. The vacuum circuit breaker according to claim 2, wherein said supporting means includes means for vertically being adjustable supporting position of the at least one spring among the first and second spring by being fastened or unfastened with a threaded portion.

4. The vacuum circuit breaker according to claim 1, said spring energizing means comprising:

a driving wheel for providing a spring energizing force to the at least one spring among the first and second springs; and means for providing a driving force to the driving wheel in order to make the driving wheel rotate.

5. The vacuum circuit breaker according to claim 4, the vacuum circuit breaker comprises;

said driving wheel having a eared portion formed on an outer circumference thereof in order to receive the driving force; and said means for providing the driving force including a motor for providing a rotating power and a driving pole disposed between the motor and the driving wheel in order to transmit the rotating power from the motor to the driving wheel.

6. The vacuum circuit breaker according to claim 4, comprising;

said driving wheel having a ear portion formed on an outer circumference thereof in order to receive the driving force; and said means for providing the driving force including a motor for providing a rotating power and a gear interposed between the motor and driving wheel and meshed with the gear portion of the driving wheel in order to transmit the rotating power from the motor to the driving wheel.

7. The vacuum circuit breaker according to claim 4, further comprising:

said driving wheel having a geared portion formed on an outer circumference thereof in order to transmit the driving force; and said means for providing the driving force including a handle shaft for providing a rotating power, a handle for manually rotating the handle shaft, and an operating pole interposed between the handle shaft and said driving wheel for transmitting the rotating power from the handle shaft to the driving wheel.

8. The vacuum circuit breaker according to claim 4, further comprising:

said driving wheel having a geared portion formed on an outer circumference thereof in order to transmit the driving force; and said means for providing the driving force including a handle shaft for providing a rotating power, a handle for manually operating the handle shaft, and a gear interposed between the handle shaft and said driving wheel in order to transmit the rotating power from the handle shaft to the driving wheel by being meshed with the geared portion of the driving wheel.

9. The vacuum circuit breaker according to claim 4, wherein the driving wheel comprises a geared portion formed on an outer circumference thereof in order to receive the driving force, and a gearless portion formed on the outer circumference in order to detect an energization of the at least one spring among the first and second springs.

10. The vacuum circuit breaker according to claim 4, further comprising a reverse rotation restraining pole for preventing the driving wheel from rotating in a direction opposite to a rotating direction for elastically energizing the at least one spring.

11. The vacuum circuit breaker according to claim 4, further comprising:

a cam coaxially connected to a rotating shaft of the driving wheel so as to rotate with the driving wheel in order to transmit the energizing force of the at least one spring and restrain a further rotation of the driving wheel when the energizing of the at least one spring is completed; and means for restraining a further rotation of the cam when the energizing of the spring is completed.

12. The vacuum circuit breaker according to claim 11, wherein the cam rotation restraining means comprises:

a rotation restraining roller which can rotate to a further rotation preventive position or a further rotation permissive position when the energizing of the at least one spring is completed;

a first latch coaxially connected to the rotation restraining roller and rotating in a direction equal to a direction of rotation of the rotation restraining roller in order to transmit a rotating force to the rotation restraining roller; and a first solenoid for providing the rotating power to the first latch.

13. The vacuum circuit breaker according to claim 12, further comprising a latch locking bar for permitting or restraining the rotation of the first latch.

14. The vacuum circuit breaker according to claim 1, further comprising a trip latch which selectively rotates to a position for restraining or permitting the rotation of at least one link among the plurality of links in order to restrain a movement of the movable contactor separating away from the fixed contactor during a trip operation.

15. The vacuum circuit breaker according to claim 14, further comprising:

a trip lever for restraining or permitting the rotation of at least one link means among the plurality of link means by rotating the trip latch to a predetermined position; and a second solenoid for operating the trip lever.

16. The vacuum circuit breaker according to claim 1, further comprising:

a trip lever for restraining or permitting the rotation of at least one link among the plurality of links by rotating a trip latch to a predetermined position; and a second solenoid for operating the trip lever.

17. The vacuum circuit breaker according to claim 1, wherein the plurality of links includes at least three links.

18. The vacuum circuit breaker according to claim 1, further comprising means for displaying an energizing completion state or an energizing energy exhaustion state of the first spring.

19. The vacuum circuit breaker according to claim 18, wherein said means for displaying an energizing completion state or an energizing energy exhaustion state of the first spring includes a display plate which rotates in accordance with the energizing completion state or energizing energy exhaustion state of the first spring; and a see through window installed on a front plate of the vacuum circuit breaker correspondingly to the display plate.

20. The vacuum circuit breaker according to claim 1, further comprising means for displaying a turn-on state or a turn-off state of the circuit breaker, wherein the display means includes a display plate connected to a rotating shaft among the links and being rotatable therewith, a position of said display plate corresponding to the turn-on state or the turn-off state of the circuit breaker and having a display portion on the upper surface corresponding to each of the states; and a display window installed on a front surface of the vacuum circuit breaker corresponding to the display plate.

* * * * *